US005762546A

United States Patent [19]

James et al.

[11] Patent Number: 5,762,546

[45] Date of Patent: Jun. 9, 1998

[54] PNEUMATICALLY ASSISTED CONFORMAL TOOL FOR AN OPHTHALMIC LENS FINER/POLISHER

[75] Inventors: Michael D. James, Ft. Gibson; Fritz R. Kruis, Tulsa, both of Okla.

[73] Assignee: Coburn Optical Industries, Inc., Tulsa, Okla.

[21] Appl. No.: 571,585

[22] Filed: Dec. 13, 1995

[51] Int. Cl.[6] ..... B24D 9/02

[52] U.S. Cl. ..... 451/504; 451/505

[58] Field of Search ..... 451/505, 504, 451/921, 514, 548, 255, 256, 42, 59, 526

[56] References Cited

U.S. PATENT DOCUMENTS

| | | | |
|---|---|---|---|
| 1,560,033 | 11/1925 | Bart | 451/921 |
| 3,305,976 | 2/1967 | Koskie | 451/505 |
| 3,897,657 | 8/1975 | Smith | 451/921 |
| 4,831,789 | 5/1989 | Herbin et al. | 451/495 |
| 5,095,660 | 3/1992 | Dillon | 451/921 |
| 5,255,474 | 10/1993 | Gawa et al. | 451/505 |

FOREIGN PATENT DOCUMENTS 0 655 297 A 5/1995 European Pat. Off. .

2 654 027 A 5/1991 France .

*Primary Examiner*—Timothy V. Eley

*Attorney, Agent, or Firm*—Frank J. Catalano; Scott R. Zingerman

[57] ABSTRACT

A conformal tool for fining/polishing ophthalmic lenses has a rigid base, a substantially air impervious elastic membrane and a bladder conformable to a surface of the lens to be fined/polished. The perimeters of the base, the membrane and the bladder are contiguously clamped to provide a pneumatically discrete chamber between the base and the membrane and a chamber containing conformable filler such as sand between the membrane and the bladder. The pneumatically discrete and filler containing chambers together have a substantially fixed volume. The clamping provides a passage into the pneumatically discrete chamber so that air under pressure, when admitted into the pneumatically discrete chamber, stretches the membrane to increase the pneumatically discrete chamber volume and decrease the filler containing chamber volume. As air pressure is increased, the air separates the membrane from the base to build an air cushion therebetween as the conformable filler chamber volume decreases.

7 Claims, 3 Drawing Sheets

PNEUMATICALLY ASSISTED CONFORMAL TOOL FOR AN OPHTHALMIC LENS FINER/ POLISHER

BACKGROUND OF THE INVENTION

This invention relates generally to the manufacture of ophthalmic lenses and more particularly concerns conformal tools for fining and polishing ophthalmic lenses.

Most known finishing/polishing tools provide a global conformance to the lens, requiring a separate tool for every possible contour of lens. For each lens, the proper tool has to be selected and mounted on the fining/polishing apparatus. With recent development of more accurate lens surfacing equipment, modern lenses exhibit wide variations in face curvature.

While some work has been done in the development of conformal tools which can be used to fine/polish a variety of lenses, little success has been achieved in developing a single or minimal number of fining/polishing tools which will conform to all contours of lenses including toric lenses. For the most part, improved conformal tools are progressively incremented in diopter ranges so that the tool does not accurately conform progressively at any position of a lens contour. Thus, the fining/polishing process can adversely effect the accuracy of the lens geometry.

One presently known conformal tool applies air pressure under the control of the operator in the bladder of the conformal tool to control the degree of conformance to the lens. However, the use of air pressure or hydraulic pressure in the tool bladder under operator control introduces considerable inaccuracy into the system. In addition, the face of the tool tends to buckle and lose its integrity with the lens surface, introducing further error into the system.

Other recently developed conformal tools use a conformable filler in a pliant casing to contour the tool to the lens. Such tools eliminate the introduction of error due to the operator's subjective introduction of air into the bladder, but make no allowance for external factors to alter the conformal contour. Compliance is determined only by the motion of the tool during operation and the fixed characteristics of the casing and the filler.

It is, therefore, an object of this invention to provide a conformal tool for fining/polishing ophthalmic lenses affording greater local conformance than has been heretofore available. Another object of this invention is to provide a conformal tool for fining/polishing ophthalmic lenses which resists buckling and maintains its integrity in conformance to the lens. Still another object of this invention is to provide a conformal tool for fining/polishing ophthalmic lenses that does not require pneumatic or hydraulic pressure in the tool bladder to achieve conformance to a lens. Yet another object of this invention is to provide a conformal tool for fining/polishing ophthalmic lenses which is usable for both fining and polishing.

SUMMARY OF THE INVENTION

In accordance with the invention, a conformal tool for fining/polishing ophthalmic lenses has a rigid base, a substantially air impervious elastic membrane and a bladder conformable to a surface of the lens to be fined/polished.

The perimeters of the base, the membrane and the bladder are contiguously clamped to provide a pneumatically discrete chamber between the base and the membrane and a chamber containing conformable filler such as sand between the membrane and the bladder. The pneumatically discrete and filler containing chambers together have a substantially fixed volume. The clamping provides a passage into the pneumatically discrete chamber so that air under pressure inlet to the pneumatically discrete chamber stretches the membrane to increase the pneumatically discrete chamber volume and decrease the filler containing chamber volume. As air pressure is increased, the air separates the membrane from the base to build an air cushion therebetween as the conformable filler chamber volume decreases.

In a specially preferred embodiment, the base is a rigid circular domelike structure with a flattened central portion extending from a peripheral flange. A spacer ring of depth less than the depth of the domelike structure is seated on the flange. The air inlet extends through the spacer ring. The air impervious elastic membrane is substantially circular and extends across the flattened portion of the domelike structure. A first clamping ring secures the perimeter of the membrane against the spacer ring with the membrane stretched across the portion of the domelike structure which extends beyond the spacer ring. The bladder is substantially hemispherical. A second clamping ring secures the perimeter of the bladder against the first clamping ring. A plurality of bolts extend through holes aligned in the perimeter of all the components other than the bladder to contiguously fix the perimeters of the base, the spacer ring, the membrane, the first clamping ring, the bladder and the second clamping ring. This provides the pneumatically discrete chamber between the base, the spacer ring and the membrane and the filler chamber between the membrane, the first clamping ring and the bladder. Preferably, the bolts are threadedly engaged in the second clamping ring holes. The rear portion of the base is adapted for connection to a chuck of a fining/polishing machine.

It is specially preferred that the first clamping ring has a flange extending from its inner diameter into the bladder, that the bladder has a flange extending about its hemispherical edge between the first and second clamping rings and that the first clamping ring has an annular seat along its inner diameter for receiving the bladder flange, all assuring a stable connection between these components.

BRIEF DESCRIPTION OF THE DRAWINGS:

Other objects and advantages of the invention will become apparent upon reading the following detailed description and upon reference to the drawings in which.

Figure 1:
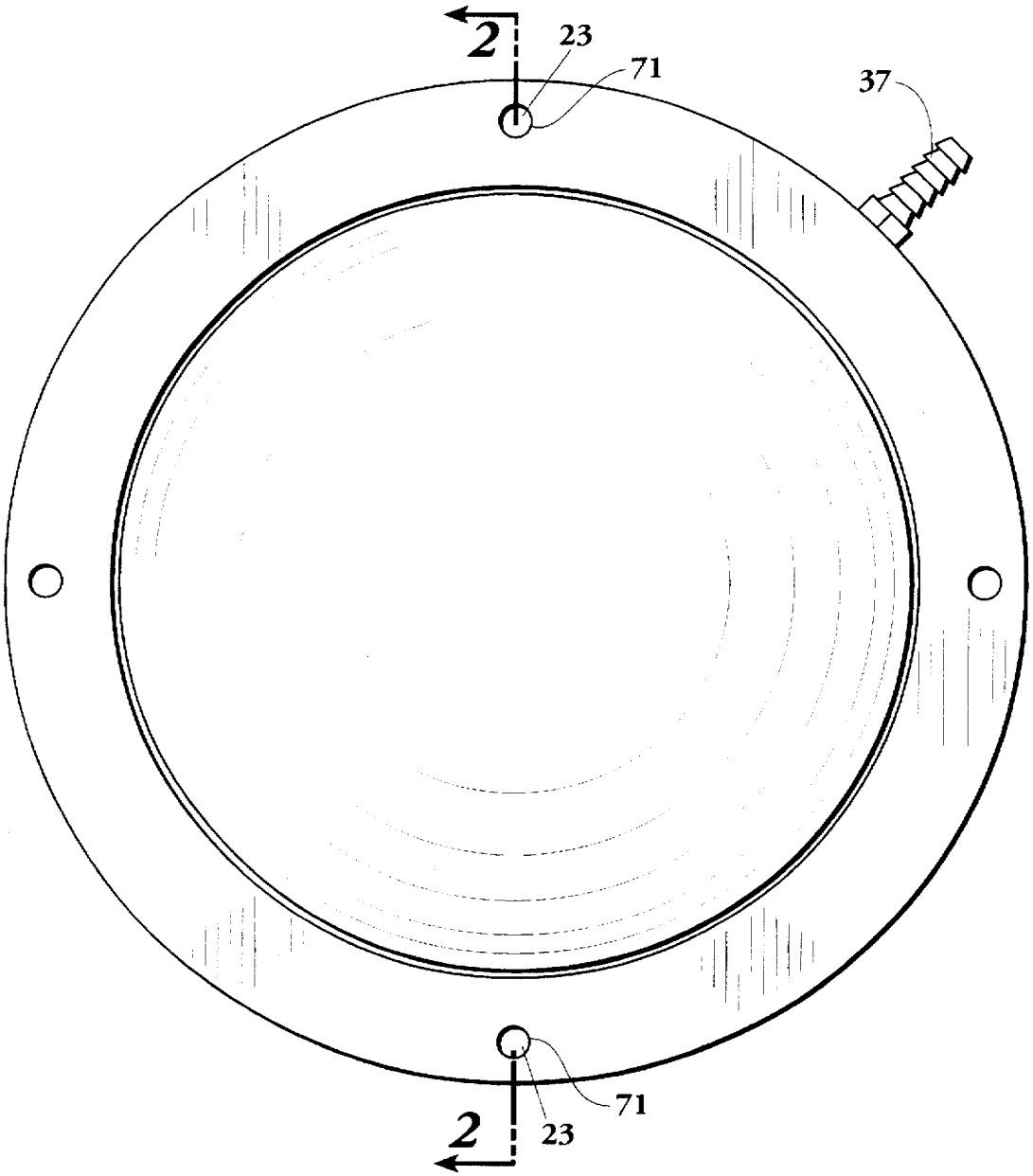
FIG. 1 is a front elevation view of a preferred embodiment of the pneumatically assisted conformal tool.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Turning now to the drawings, the conformal tool has a substantially rigid base 10, preferably of metal such as steel or aluminum. The front face 11 of the base 10 is essentially a dome-like structure having a flattened center portion 13. A peripheral flange 15 extends about the outer diameter of the dome-like portion 11. The rear portion 17 of the base 10 is adapted by recesses 19 for attachment to the chuck of a polishing/fining machine (not shown). As shown, the peripheral flange 15 is fitted with a plurality of countersunk holes 21 for seating the heads of a plurality of bolts 23. A spacer ring 30, preferably also of metal, such as steel or aluminum, is of diameter such that the ring 30 is seated on the peripheral flange 15 of the base 10. The depth 31 of the spacer ring 30 is substantially less than the depth 27 of the dome-like face 11 of the base 10. The spacer ring 30 has a plurality of holes 33 aligned with the holes 21 in the base 10. The spacer ring 30 also has an air inlet hole 35 in which an air inlet connector 37 is mounted for connection to a source of air under pressure (not shown).

A circular elastic membrane 40 extends over the flattened center 13 of the base 10 to the outer edge of the spacer ring 30. Holes 41 through the membrane 40 align with the holes 33 in the spacer ring 30.

A clamping ring 50 of diameter substantially equal to the diameter of the spacer ring 30 is seated on the outer perimeter of the elastic member 40 and presses the outer perimeter of the elastic member 40 against the face of the spacer ring 30. This causes the inner portion 43 of the elastic membrane 40 to stretch slightly to conform to the flattened central portion 13 and to the portion of the dome-like face 11 of the base 10 which extends beyond the depth 31 of the spacer ring 30. The clamping ring 50 is preferably made of metal such as steel or aluminum and has holes 51 extending therethrough in alignment with the holes 41 in the membrane 40.

A bladder 60, as shown of substantially hemispherical body 61, is formed from a material suitable for conformance to the contour of a lens (not shown) to be polished/fined. As shown, the bladder 60 will preferably have a flange 63 about its outer hemispherical perimeter. The diameter of the bladder body 61 and flange 63 are such that the flange is seated on the inner portion of the clamping ring 50 so as not to block the holes 51 through the clamping ring 50. Also as shown, the clamping ring 50 has a flange 53 extending from its inner diameter into the bladder body 61.

Another clamping ring 70, preferably of metal, such as steel or aluminum, has an outer diameter substantially equal to the outer diameter of the first clamping ring 50 and an inner diameter substantially equal to the outer diameter of the bladder body 61. Thus, the second clamping ring 70 can be seated over the bladder body 61 to secure the bladder flange 63 against the first clamping ring 50. As shown, the second clamping ring 70 will preferably have an annular seat 71 along its inner diameter to receive the bladder flange 63. The second clamping ring 70 is also provided with a plurality of holes 73 which are preferably threaded to receive the threaded ends 25 of the bolts 23 which hold the assembly together.

Figure 2:
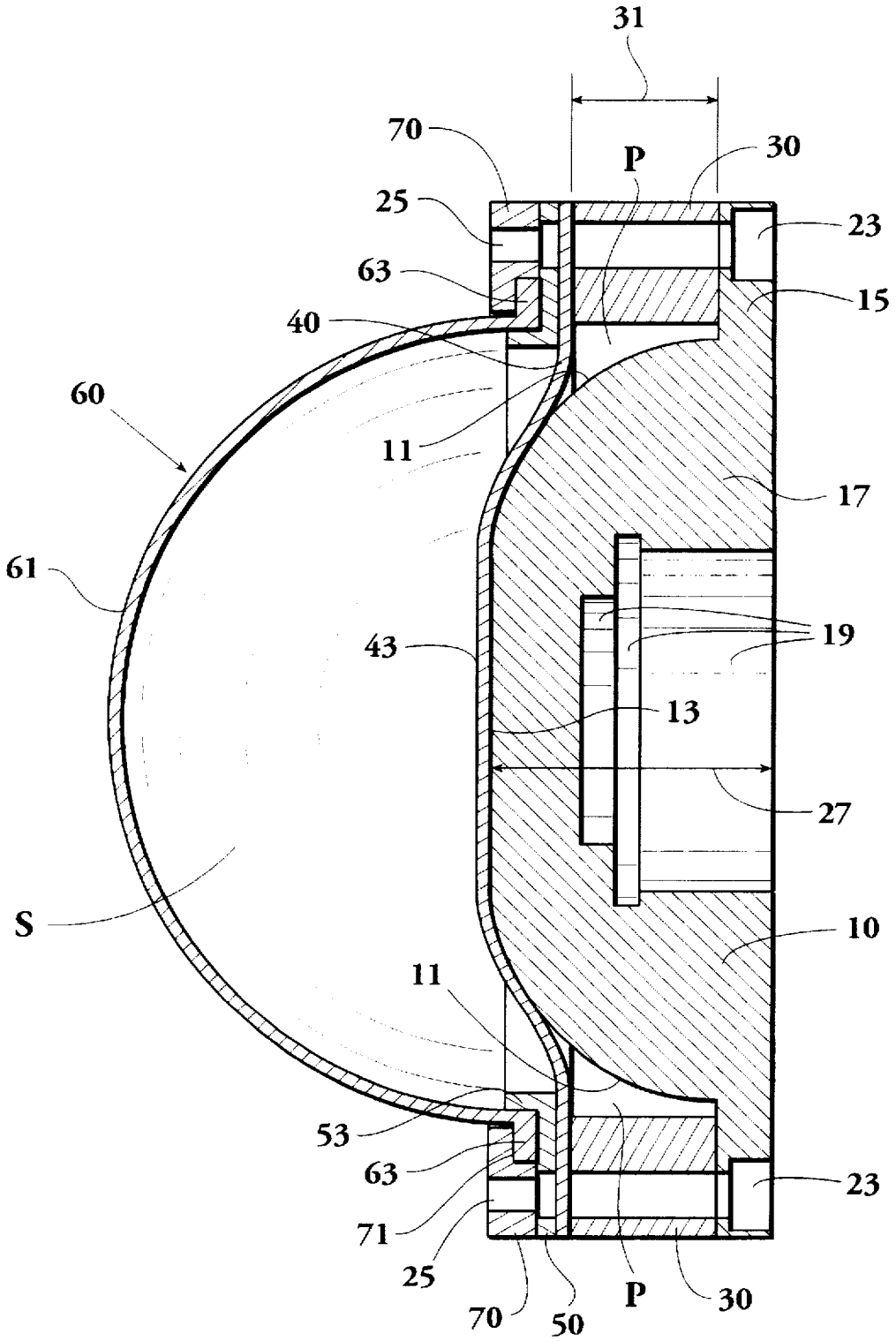
FIG. 2 is a cross-sectional view taken along the line 2—2 of FIG. 1.
Figure 3:
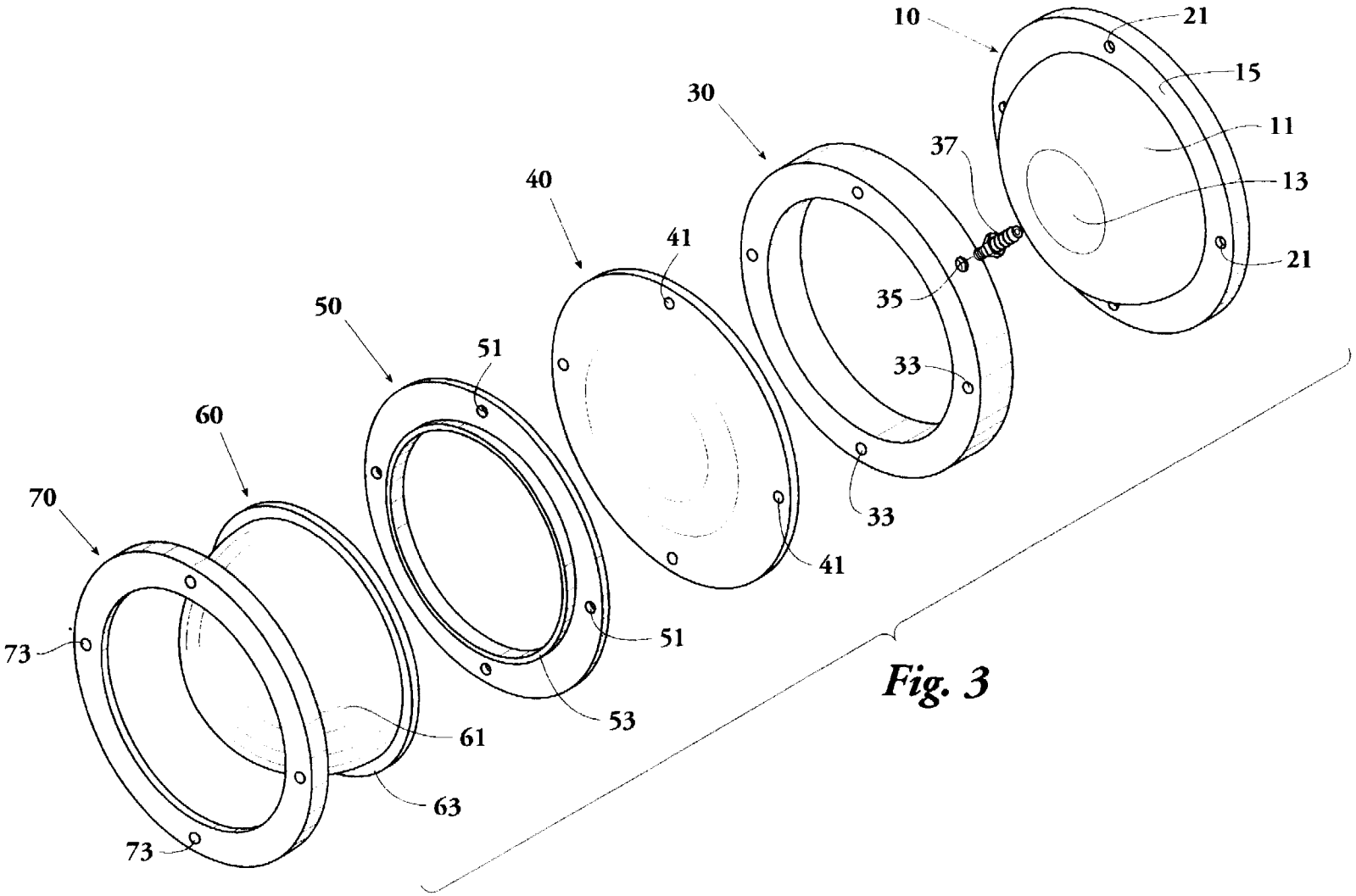
FIG. 3 is a perspective view illustrating the components of the tool of FIG. 1 aligned for assembly.

As can best be seen in FIG. 2, the base 10, the spacer ring 30 and the membrane 40 cooperate to define a pneumatically discrete chamber P. The membrane 40, the first clamping ring 50 and the bladder 70 define another chamber S for containing the conformable filler such as sand (not shown).

The bladder 60 and the membrane 40 may, for example, be made of nitrile rubber such as type BUNA-N by Ozark Rubber Products of Bentonville, Ark.

In operation, at relatively low pressure in the pneumatically discrete chamber P, the membrane 50 will be held snugly against the flattened center portion 13 of the base and be contoured around a portion of the dome-like surface 11 of the base, as is shown in FIG. 2. If a change in the conformal characteristics of the bladder 60 is desired, air under pressure is introduced into the pneumatically discrete chamber P through the inlet 37 and the spacer ring air inlet hole 35. As the air pressure in the pneumatically discrete chamber P increases, the elastic membrane 40 will stretch, permitting the air to provide a pad between the flattened center portion 13 of the base 10 and the membrane 40. Furthermore, since the overall volume of the pneumatically discrete chamber P and the filler containing chamber S is substantially constant, the volume of the filler chamber S is decreased, thus applying controllable pressure on the filler without introducing air into the bladder 60.

Thus, it is apparent that there has been provided, in accordance with the invention, a tool that fully satisfies the objects, aims and advantages set forth above. While the invention has been described in conjunction with specific embodiments thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. A conformal tool for fining/polishing ophthalmic lenses comprising:

an rigid circular base having a arcuate front surface with a flattened central portion extending from a peripheral flange;

a spacer ring of depth less than a depth of said arcuate front surface seated on said flange;

a substantially circular air impervious elastic membrane extending across said flattened portion of said arcuate surface;

a first clamping ring securing a perimeter of said membrane against said spacer ring with said membrane stretched across a portion of said arcuate surface extending beyond said spacer ring;

a substantially hemispherical bladder forming an outer surface conformable to a surface of the lens to be fined/polished;

a second clamping ring securing a perimeter of said bladder against said first clamping ring; and means contiguously fixing perimeters of said base, said spacer ring, said membrane, said first clamping ring, said bladder and said second clamping ring to provide a pneumatically discrete chamber between said base, said spacer ring and said membrane and a chamber containing conformable filler between said membrane, said first clamping ring and said bladder, said pneumatically discrete and filler containing chambers together having a substantially fixed volume;

said spacing ring having a passage therethrough into said pneumatically discrete chamber whereby air under pressure let into said pneumatically discrete chamber stretches said membrane to increase said pneumatically discrete chamber volume and decrease said filler containing chamber volume.

2. A tool according to claim 1, said conformable filler being sand.

3. A tool according to claim 1, said base having a rear portion adapted for connection to a chuck of a fining/polishing machine.

4. A tool according to claim 1, said first clamping ring having a flange extending from an inner diameter thereof into said bladder.

5. A tool according to claim 4, said bladder having a flange extending about a hemispherical edge thereof and between said first and second clamping rings.

6. A tool according to claim 5, said first clamping ring having an annular seat along an inner diameter thereof for receiving said bladder flange therein.

7. A tool according to claim 1, said fixing means comprising a plurality of holes spaced about and aligned through perimeters of said base, said spacer ring, said membrane and said first and second clamping rings, said second clamping ring holes being threaded, and a plurality of bolts extending through said holes and having ends threadedly engaged in said second clamping ring holes.

* * * * *